United States Patent [19]

Van Dam et al.

[11] 3,981,733

[45] Sept. 21, 1976

[54] SILVER HALIDE PHOTOGRAPHIC MATERIALS CONTAINING THE ADDITION PRODUCTS OF LOWER ALKYLENE OXIDES AND ORGANIC POLYAMINES AS ANTI-FOG COMPOUNDS

[75] Inventors: Max Van Dam, Oradell, N.J.; Stephen Robert Gallo, Yonkers, N.Y.

[73] Assignee: Polychrome Corporation, Yonkers, N.Y.

[22] Filed: July 31, 1974

[21] Appl. No.: 493,281

[52] U.S. Cl. ..... 96/67; 96/76 R; 96/109; 96/66.5

[51] Int. Cl.[2] ..... G03C 1/34

[58] Field of Search ..... 96/109, 76 R, 67, 66.5, 96/66.3, 107, 114.7, 114.5, 95, 50 PL

[56] References Cited

UNITED STATES PATENTS

| | | | |
|---|---|---|---|
| 2,400,532 | 5/1946 | Blake et al. | 96/109 |
| 2,976,150 | 3/1961 | Smith | 96/114.7 |
| 3,307,948 | 3/1967 | Thiers et al. | 96/95 |
| 3,833,378 | 9/1974 | Hayashi et al. | 96/66.3 |

*Primary Examiner*—Won H. Louie, Jr.

[57] ABSTRACT

Anti-fog compounds for silver halide photographic emulsions are disclosed. These compounds comprise the addition products of lower alkylene oxides and organic polyamines. The addition products of ethylene diamine and propylene oxide-ethylene oxide are especially useful in this application.

13 Claims, No Drawings

SILVER HALIDE PHOTOGRAPHIC MATERIALS CONTAINING THE ADDITION PRODUCTS OF LOWER ALKYLENE OXIDES AND ORGANIC POLYAMINES AS ANTI-FOG COMPOUNDS

BRIEF DESCRIPTION OF THE INVENTION

The present invention relates to anti-fog compounds for silver halide photographic emulsions, especially high contrast emulsions used in the manufacture of lithographic film. These compounds comprise the addition product of lower alkylene oxides and organic polyamines. Excellent anti-fog properties are obtained with a compound having a molecular weight of from about 3400 to about 5500 that is prepared by the sequential addition of lower alkylene oxides comprising propylene oxide and ethylene oxide to ethylene diamine where the ethylene oxide is from about 20% to about 50% of the total lower alkylene oxide in the compound. This compound can be added to the emulsion directly, the developer, or the subbing layer of the base for the emulsion film. Very good results are obtained when the aforementioned compound is used in an anti-abrasion layer of gelatin coated over a film of the emulsion.

DETAILED DESCRIPTION OF THE INVENTION

The present invention relates to anti-fog compounds for silver halide photographic emulsions. Fog in silver halide emulsions may be generally described as the darkening of the emulsion in areas where it was not exposed to light and which is evident after development. Fog is undesirable since it causes loss of clarity and contrast in photographic reproductions. Fog is caused by heat, humidity, aging and chemicals such as hydrogen sulfide, hydrogen peroxide and reducing agents used in developers for imagewise exposed silver halide photographic emulsions. Fog can be overcome by combining anti-fog compounds with the silver halide emulsion; however, when the anti-fog compound is used it reduces the speed at which the developer works and consequently the anti-fog compound must affect a rate of decrease of fog greater than the rate at which it reduces the speed of the developer.

Fog is measured on silver halide photographic emulsion films as the optical density of the portion of the developed emulsion which is not exposed to light. In some instances in the prior art the value measured for fog also includes the optical density of the transparent base on which the emulsion is coated as well as the optical density of the unexposed and developed silver halide emulsion (Base and fog). For purposes of the present invention, the term fog used herein is intended as defining the optical density of the unexposed area of the developed silver halide emulsion film including the density of the base.

Optical density is the log of the reciprocal of light transmittance, light transmittance being measured by a standard photoelectric cell densitometer. Transmittance is the ratio of the amount of light that an object passes to the total amount that falls on the object. Optical density then is expressed by the following equation:

$$D = \log 1/T$$

where D is optical density and T is transmittance.

The property of a silver halide emulsion to develop a high degree of contrast between exposed and unexposed areas is important in printing processes that employ silver halide emulsions in the manufacture of printing plates since this gives sharper definition between background and the type face being photographed. This high contrast is measured as the slope of a curve obtained by plotting density as the ordinate and the log of the exposure as the abscissa. Exposure in this instance is expressed in units of meter-candle-seconds. The steeper the slope of this curve the higher the contrast since a relatively low exposure will produce a high degree of darkening or high optical density. The tangent of the angle which the straight line portion of this curve makes with the abscissa is used to measure the slope and is referred to as gamma. The higher the value of gamma, the higher the contrast of the film.

In measuring gamma of a photographic film in the laboratory, one method comprises exposing the silver halide emulsion with a standard light source through a step wedge transparency which is a series of numbered parallel bands of increasing optical density starting from a transparent band numbered "1" having a density 0.00 on one end of the transparency up through one which is numbered 41 having a density 2.00 at the other end of the transparency and which is exposed in such a way that it does not transmit light through step 41. The silver halide emulsion exposed through the wedge results in a complementary wedge in the developed emulsion, i.e., bands of high density (opaqueness) where bands of relative transparency were in the original step wedge transparency and bands of relative transparency where bands of high density were in the original. The silver halide emulsion is exposed through the step wedge under conditions established experimentally so that the chosen band of first reference density to be obtained upon development of the exposed silver halide emulsion is approximately in the middle of the step wedge. The optical density of this band of first reference may be arbitrarily set at about 2.5 or higher. The number of the band which corresponds to an optical density of 2.5 (a light transmittance of about 0.5%) is designated as the relative speed herein. A second chosen band of reference density may be anywhere from 0.3 density or 50% light transmittance on through a density approaching 0 or 100% light transmittance. As can be readily appreciated, the fewer the number of bands between the chosen transparent and opaque bands the higher the contrast or the higher the gamma of the film. When employing a step wedge for measuring the contrast, the contrast of the film is referred to as gamma or gradation. The contrast can also be expressed as a gradation coefficient, which is the number of parallel bands separating the chosen opaque and transparent bands. There is an inverse relationship between gamma, or gradation, and gradation coefficient. Thus if there is a five band difference between a band of 2.5 optical density and a band of 0.3 optical density the contrast would be higher and the gradation coefficient lower than a ten band difference at these optical densities.

It is one of the objects of the present invention to provide a fog inhibitor for silver halide emulsions.

It is another object of the invention to provide a fog inhibitor for high contrast silver halide emulsions.

It is another object of the present invention to decrease the gradation coefficient or increase gamma of high contrast silver halide emulsions.

These and other objects have been achieved by the present invention by employing certain surfactants as anti-fog compounds for silver halide emulsions. The anti-fog compounds are surfactants having organic hydrophobic and organic hydrophilic portions in the surfactant molecule and are preferably water soluble at a temperature from about 20° to about 40°C. or the temperature at which the emulsion is made and coated onto a base. The solubility of the surfactant is also dependent on its concentration which for the purpose of the invention will be that concentration of surfactant in water that inhibits fog, the amount of water in turn being the water used in manufacturing the emulsion or in the application of a coating on the emulsion. The anti-fog compounds of the invention have the following formula:

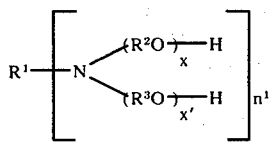

where $R^1$ is a polyvalent organic radical having up to about 6 carbon atoms such as a saturated or unsaturated 6 carbon atom cyclic radical or an aliphatic radical having up to about 6 carbon atoms and is preferably a lower alkylene radical having up to about 6 carbon atoms.

The radicals $—R^2O—$and$—R^3O—$ may be the same or different and are lower oxyalkylene radicals i.e. radicals having up to about 4 carbon atoms such as oxyethylene, oxy-propylene and the isomers thereof and oxybutylene and the isomers thereof.

The sum of $x$ and $x'$ is such that the total number of radicals $—R^2O—$and$—R^3O—$ has a value greater than about 33 to about 500 and especially from about 60 to about 180. By way of illustration, when the sum of $x$ and $x'$ is 50 and $n^1$ is 2 the compound will have a total of 100 $—R^2O—$and$—R^3O—$ radicals.

In the above formula also each of the radicals $—R^2O—$and$—R^3O—$ are preferably repeating lower oxyalkylene radicals i.e. the radical $R^2O$ may stand for a mixture of oxymethylene, oxyethylene and oxypropylene radicals in any order or sequence.

Further examples, of repeating lower oxyalkylene radicals, are poly(oxypropylene)-poly(oxyethylene) or poly(oxyloweralkylene) such as poly(oxypropylene) or poly(oxyethylene).

In the above formula, $n^1$ is a number greater than 1 and is an average value so that in a mixture of compounds $n^1$ may have a value of 1.5 or 1.75 and so forth. In one embodiment $n^1$ has a value greater than one and up to a value of about 2. In a further embodiment $n^1$ is about 2.

The compounds of the present invention are produced by the condensation of a polyamine with various oxygenated compounds having active hydrogens such as the condensation of an organic polyamine e.g. an alkylene polyamine or a lower alkylene diamine with oxygenated compounds having active hydrogens that include formaldehyde, paraformaldehyde, ethylene oxide, propylene oxide, butylene oxide and the like. The alkylene polyamines such as ethylene diamine may be reacted first with formaldehyde and subsequently condensed with a low molecular weight alkylene oxide. In another embodiment a lower alkylene diamine such as ethylene diamine is reacted with propylene oxide to obtain a condensation product, the condensation product being subsequently reacted with ethylene oxide to obtain a hydrophilic-hydrophobic chain attached to the nitrogen atom or atoms.

The compounds that are especially useful for the purposes of the present invention may be further illustrated by the following formula:

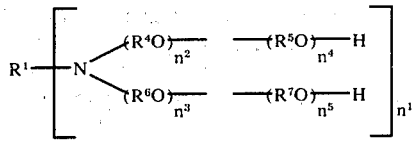

where $R^1$ has been described above; $—R^4O—$, $—R^5O—$, $—R^6O—$, and $—R^7O—$, are lower oxyalkylene radicals as described above; preferably, $—R^4O—$ and $—R^6O—$ are the same and $—R^5O—$ and $—R^7O—$ are the same; however, $—R^5O—$ and $—R^7O—$ are different from $—R^4O—$ and $—R^6O—$.

In one embodiment $—R^4O—$ and $—R^6O—$ are oxypropylene and $—R^5O—$ and $—R^7O—$ are oxyethylene radicals.

The sum of $n^2$, $n^3$, $n^4$ and $n^5$ is such that the total number of radicals $—R^4O—$, $—R^5O—$, $—R^6O—$, and $—R^7O—$ is from a value greater than about 33 to about 500 especially from about 60 to about 180 and preferably the aforesaid radicals are repeating lower oxyalkylene radicals. In one embodiment $n^2$ and $n^3$ are substantially the same and $n^4$ and $n^5$ are substantially the same. When $—R^4O—$ and $—R^6O—$ are oxypropylene and $R^5$ and $R^7$ are oxyethylene the sum of $n^2$, $n^3$, $n^4$ and $n^5$, is such that the compound will have a molecular weight greater than about 1650 to about 27,000 or greater than about 1650 to about 9000 especially where $n^1$ is about 2 and $R^1$ is lower alkylene.

One class of compounds within the above formula suited for use according to the present invention are Tetronic (registered trademark BASF Wyandotte, Wyandotte, Mich.) polyols of the following formula:

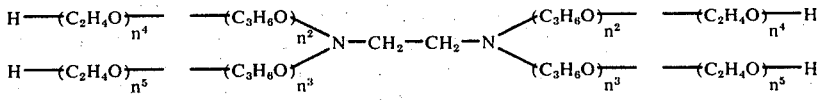

where $n^2$, $n^3$, $n^4$ and $n^5$ have been defined above. The Tetronic polyols are substantially nonionic surface active agents prepared by the sequential addition of propylene oxide followed by ethylene oxide to ethylene diamine. By adjusting the amounts of propylene and ethylene oxides it is possible to prepare products of widely different molecular weight and hydrophobic-hydrophilic balance. These products are manufactured in a molecular weight range greater than about 1650 to about 27,000 and contain anywhere from about 10 to about 20% oxyethylene radicals, up through about 80 to about 90% oxyethylene radicals based on the total oxypropylene and oxyethylene radicals in the compound. Preferred compounds are those having a molecular weight range greater than about 1650 to about 9000, a viscosity at 25°C. of from about 450 to about 1570 cps and which are ordinarily liquids at room temperature i.e. 25°C. Preferred compounds inter alia include Tetronic 702 having a molecular weight of about 4000, an oxyethylene content of about 20 to about 30% of the total oxyethylene and oxypropylene radicals in the compound, Tetronic 504 having a molecular weight of about 3400 with an oxyethylene content of about 40 to about 49% of the total oxyethylene and oxypropylene radicals in the compound and Tetronic 704 having a molecular weight of about 5500 with an oxyethylene content of about 40 to about 49% of the total oxyethylene and oxypropylene radicals in the compound.

Thus in one embodiment the aforementioned anti-fog compound has a molecular weight of from about 3400 to about 5500 and an oxyethylene content of from about 20 to about 50% of the total oxyethylene and oxypropylene radicals.

The silver halide photographic emulsions of the present invention are made by the co-precipitation of silver nitrate and an alkali metal halide such as potassium halide, mainly potassium chloride and optionally lesser amounts of potassium iodide and/or potassium bromide, each of which (i.e. the silver nitrate and silver halide) is mixed with photographic grade gelatin. The silver nitrate and alkali metal halide enter into a double decomposition reaction and are converted respectively into a silver halide and potassium nitrate after which they are subjected to a "ripening" step which is employed to maximize crystal growth of the silver halide. Generally two ripening steps are employed, the first of which is called Ostwald ripening and the second of which is coalescence. Ostwald ripening takes advantage of the phenomena whereby larger crystals of silver halide which are formed in the reaction of silver nitrate and potassium halide increase in size at the expense of smaller silver halide crystals also formed because the smaller crystals are slightly more soluble than the larger crystals. In coalescence ripening a faster change in crystal development occurs by virtue of the welding together of larger crystals. Ripening is an essential step in the production of silver halide emulsions since it has been demonstrated that photographic sensitivity to light or the developability of a silver halide emulsion increases with the size of the silver halide crystals.

Ostwald ripening is effected either in the absence of added ammonia or by the addition of ammonia, the latter ripening being quicker and occuring at a lower temperature than the so-called neutral method in which no ammonia is employed. When using ammonia the emulsions are ripened at a temperature not exceeding 50°C. whereas neutral emulsions are ripened between about 40° and 90°C., the time of ripening being generally less than 1 hour and more in the order of about ½ hour. It has also been shown that the higher the temperature and the longer the time of ripening, the greater the range of grain size and the maximum size of the grains is also generally larger. The emulsion is then gelled and formed into "noodles" in order to increase the surface area for the subsequent washings that are employed to remove any residual silver nitrate, potassium nitrate and potassium halide, or the emulsion is coagulated in accordance with known techniques and the supernatent solution of salts is decanted. If desired, the coagulated gelatin, or "curd", may be washed and the decanting may be repeated. This sequence of steps may be repeated as many times as desired. A solution of a polyvalent salt may be employed, particularly for subsequent washings because it does not redisperse the gelatin as pure water would.

The washed emulsion is then melted at elevated temperatures and the last of the gelatin added along with optical sensitizers such as cyanine dyes, merocyanine dyes and the art-known equivalents thereof or chemical sensitization may be effected by means of gold salts such as potassium chloroaurate as taught in U.S. Pat. No. 2,399,083 to Waller et al. Additionally, the emulsions may be treated with the salts of the noble metals such as ruthenium, rhodium and palladium which act as sensitizers when used in low concentrations and as fog inhibitors when used in high concentrations as described in U.S. Pat. No. 2,488,060 Smith et al. and U.S. Pat. No. 2,566,245 and 2,566,263 Trivelli et al. Gold salts may also be used to stabilize the emulsion as described in U.S. Pat. No. 2,597,856 Damschroder and U.S. Pat. No. 2,597,915 Yutzy. Chemical sensitization may also be effected with stannous salts whereas stabilization is also possible by employing mercury compounds all of which is taught in the prior art.

During or after the second ripening or coalescing or at the time of final remelting prior to coating, other compounds are also added to the emulsions such as alcohol to help the flow of the emulsion, thymol which is a preservative, potassium bromide as a fog inhibitor and chrome alum as a gelatin hardening agent. In addition to potassium bromide other anti-fog compounds known in the art may be employed such as chloride and iodide salts. Other gelatin hardening agents that may be used include formaldehyde, formalin, oxaldehyde, dialdehydes such as glyoxal and homologs, dialdehydes such as glutaric dialdehyde, beta-methylglutaric dialdehyde, maleic dialdehyde, succinic dialdehyde and methoxysuccinic dialdehyde, divinyl sulfone, dimethylol urea, a condensation of two moles of formaldehyde and one mole of urea. Excessive formaldehyde and dimethylol urea have been demonstrated to increase the fog of the silver halide photographic emulsion as does excessive mucochloric acid and mucobromic acid and similar chlorinated aldehyde acids.

After the first or Ostwald ripening, the second or coalescing ripening and the addition of various anti-foggants, sensitizers and the like, the photographic emulsion is placed on a substrate or base such as glass, clear cellulose acetate or a clear polyester film such as poly(ethylenegycolterephthalate) known in the art as Mylar (trademark E. I. DuPont deNemours and Company, Inc.).

An anti-abrasion layer made of gelatin containing any one or combination of the aforementioned gelatin hardeners may be placed over the emulsion film as a protective coating.

The silver halide emulsion thus used as a film on a substrate or base is photosensitive and upon imagewise exposure to visible light the areas of the silver halide emulsion struck by visible light are converted to silver metal. These silver metal areas are centers for further development which occurs when the emulsion film is placed into a developing solution which contains a reducing agent such as hydroquinone which reduces the silver halide to silver metal in the areas that have been struck by light. The developer may contain an anti-fog compound. After development the silver halide emulsion film is then placed in a fixer such as sodium thiosulfate which forms a complex with the unexposed silver halide so that it may be removed from the surface of the film.

The anti-fog compounds of the invention may be combined with the silver halide emulsion at any point in the manufacture of or development of the film such as by incorporating these anti-fog compounds in the emulsion after reacting the silver nitrate and alkali metal halide, during the Ostwald ripening and/or the coalescing or second ripening, in the developer, in the anti-abrasion layer or in the subbing layer of the base or any combination of the foregoing.

Other anti-foggants that may be combined with the silver halide emulsion in combination with the anti-fog compounds of the invention include those previously mentioned and the art-known anti-fog compounds such as 4-hydroxy-6-methyl-1,3,3A,7-tetraazaindene and 5-carboxy-4-hydroxy-1,3,3A,7-tetraazaindene which are also known as azaindene compounds. These tetraazaindene compounds are sometimes named as derivatives of indolizene or pyrimidine. Other anti-fog compounds which can be combined with the anti-fog compounds of the invention include nitro-benzimidazoles, nitro-indazoles, mercaptans, oxazoles, thiazoles, triazoles and tetrazoles, thioanalides and thioglycolic acids, quaternary salts of oxaselenazoles and salts of oxathiazoles, mercaptopyrimidines, hydroxy pyrimidines, and amino pyrimidines, pyrazoles and pyrazolones, amines, amides, hydroxy polyazaindenes and amino polyazaindenes, sufinic and selenic acid derivatives, acetylenes; the compounds described by Birr in Z. Wiss. Phot. Vol. 47, 1952, pp. 2–58 the compounds in German Pat. Nos. 524,121; 677,377; 707,386 and 709,195; British Pat. No. 1,173,609 and U.S. Pat. No. 3,179,520 Miara et al.

In addition to the gelatin previously described the silver halide may be suspended in other polymeric binding agents such as collodion, albumin, cellulose derivatives, casein, vinyl polymers and the like and various mixtures thereof.

In photographic parlance "emulsion" or "photographic emulsion" is many times used in two different senses without an explicit indication of which sense is meant. The two senses are: (1) The emulsion which is prepared, which contains substantial quantities of water and which is generally to be deposited on a substrate so that it may be dried to a substantially non-tacky coating. (2) That light sensitive coating which may be used for photographic purposes, exposed to light and developed in order to form an image.

When used in this application references to concentrations of components are to either the fluid emulsion which is to be coated or the liquid solution for the anti-abrasion layer which is to be coated, etc. unless the context indicates otherwise.

The amount of water in the photographic emulsion to be coated may be anywhere from about 35% to about 85% by weight whereas the coating solution for the anti-abrasion layer or subbing layer may contain up to 99% by weight of water. Incorporation of the anti-fog compound of the invention in either the emulsion to be coated or the emulsion coating, the coating solution for the anti-abrasion layer or the layer itself or the coating solution for the subbing layer or the layer itself or as a water solution per se in an amount effective to inhibit fog is easily determined by a person with ordinary skill in the art. The amount of anti-fog compound that is water soluble for use according to the invention is also readily determined by a person having ordinary skill in the art. The amount of surfactant that is effective in this regard is greater than about 0.01 mg. per 100 mg. of silver in the emulsion to be coated and may range from about 0.01 mg. to about 0.1 mg. per 100 mg. of silver in the emulsion to be coated for high contrast emulsions. These amounts can vary depending on the type of film.

All data reported in the examples are expressed so that the results of each example can be related to one another. The following Examples are illustrative.

EXAMPLES 1–4

A high contrast silver halide photographic emulsion to be coated containing approximately 70 mole % silver chloride, approximately 30 mole % silver bromide and approximately 100 g. gelatin per mole of silver halide is prepared with gold salts, sulfur compounds and orthochromatic sensitizers. The customary adjuvants were added, viz. 5-hydroxy-7-methyl-1,2,8-triazaindolizine as stabilizer, saponin as a wetting agent, and mucochloric acid as a hardener. The resultant emulsion contained about 27% solids, 63% water and 10% ethyl alcohol on a weight basis.

The silver halide emulsion is then applied as a film to a clear triacetate base previously coated on the opposite side with an anti-halation layer and an anti-abrasion layer is applied over the silver halide emulsion in order to minimize scratches and damage on the surface and to prevent friction fog. The coating solution for the anti-abrasion layer contains 0.5% wt. % dimethylol urea as a hardening agent in addition to 1.4 wt. % gelatin, with the remainder water. In each Example 2, 3, and 4 a material to be evaluated as an anti-fog compound and which is also a surface active agent is added to the anti-abrasion layer in a minimum amount to obtain the maximum lowering of surface tension, the minimum amount required having been determined experimentally. Example 1 is a control in which no surface active agent is used.

The photographic properties of the emulsion including relative speed, gradation and fog are determined after coating and drying (fresh coating) and after three days at 46°C. by exposing the film through a Stauffer Transparent Step Wedge No. CT-40 X.0.5. The film is exposed with a General Electric No. 1183/50 candle power, 6 volt lightbulb in a Colight contact printing lamp having a Color Filter Wheel containing a 0.3 Kodak Wratten neutral density filter. The distance from the light source to the step wedge was 70 inches. The strip is developed in a lithographic developer for 2.5 minutes at 20°C. The lithographic developer used was a developer system which contained hydroquinone as the only developing agent, and in which the sulfite ion was present in the form of a formaldehyde-bisulfite complex with addition of approximately 1 weight % free sodium sulfite. The pH of the developer was adjusted to 10.4 with sodium hydroxide. This composition increases the infectious development, which produces the high contrast of photographic emulsions for lithographic purposes. Infectious development is the fast development of grains in the immediate neighborhood of already-developing grains of silver halide. The relative speed is then determined as the number of the step which produces a density of 2.5. Gradation coefficient is expressed as the number of steps between density 2.5 and 0.3. Fog is determined as the optical density of the non-exposed areas.

The results are given in Table I.

TABLE I

| Ex. | Surfactant | mg of surfactant per 2278 gram coating solution | mg of surfactant overcoated per 100 mg of silver | FRESH Relative Speed | FRESH Gradation Coefficient | FRESH FOG | 3 - days oven aging at 46°C. Rel. Sp. | 3 - days oven aging at 46°C. Grad. Coeff. | 3 - days oven aging at 46°C. FOG |
|---|---|---|---|---|---|---|---|---|---|
| 1 | None | — | — | 25 | 5 | 0.00 | 22 | 10 | 0.28 |
| 2 | Triton X-200 (1) | 310 | 0.0488 | 21 | 6 | 0.00 | 22 | 10 | 0.31 |
| 3 | Tergitol 04 (2) | 350 | 0.0555 | 20 | 5 | 0.00 | 22 | 10 | 0.28 |
| 4 | Tetronic 702 | 370 | 0.0585 | 3 | 5 | 0.00 | 22 | 4 | 0 |

(1) Trademark Rhom and Haas Co. for the sodium salt of an alkyl aryl polyether sulfonate
(2) Trademark Union Carbide Corp. for the sodium sulfate derivative of 7-ethyl-2-methyl-4-undecanol It can be seen from a comparison of the data in Table I that by employing an anti-fog compound of the present invention such as Tetronic 702 a reduction in fog is obtained and about a 2½-fold decrease in gradation coefficient also occurs.

EXAMPLES 5–13

A photographic film having an anti-abrasion layer was prepared and exposed in accord with the identical procedure outlined in Examples 1–4, except different surfactants were evaluated as anti-fog compounds and the relative speed, gradation coefficient and fog were measured after 1 day aging at 24°C., 1 day oven aging 46°C. and 13 day oven aging at 46°C.

The results are given in Table II.

TABLE II

| Ex. | Surfactant | mg of surfactant per 2278 gram Coating solution | mg of surfactant overcoated per 100 mg of silver | 1-Day Aging-24°C. Rel. Sp. | 1-Day Aging-24°C. Grad. Coeff. | 1-Day Aging-24°C. Fog | 1-Day Oven Aging-46°C Rel. Sp. | 1-Day Oven Aging-46°C Grad. Coeff. | 1-Day Oven Aging-46°C Fog | 13-Days Oven Aging-46°C Rel. Sp. | 13-Days Oven Aging-46°C Grad. Coeff. | 13-Days Oven Aging-46°C Fog |
|---|---|---|---|---|---|---|---|---|---|---|---|---|
| 5 | None | — | — | 22 | 11 | 0.17 | | | | | HEAVY FOG | |
| 6 | Triton X-200 | 310 | 0.0488 | | FOG | | | | | | | |
| 7 | Triton X-165 (1) | 220 | 0.0350 | | HEAVY FOG | | | | | | HEAVY FOG | |
| 8 | Tetronic 504 | 310 | 0.0488 | 21 | 4 | 0.02 | 22 | 4 | 0.01 | 22 | 4 | 0.01 |
| 9 | Tetronic 704 | 260 | 0.0413 | 21 | 6 | 0.00 | 26 | 7 | 0.04 | | HEAVY FOG | |
| 10 | Monateric Cy—Na (2) | 160 | 0.0252 | | HEAVY FOG | | | HEAVY FOG | | | | |
| 11 | Tetronic 702 | 40 | 0.0063 | | HEAVY FOG | | | HEAVY FOG | | | | |
| 12 | Tetronic 702 | 370 | 0.0585 | 7 | 3 | 0.00 | 11 | 3 | 0.00 | 18 | 3 | 0.00 |
| 13 | Tetronic 702 | 3700 | 0.5859 | 0 | 0 | 0.00 | 0 | — | 0.00 | 0 | — | 0.00 |

(1) Octylphenoxy polyethoxy ethanol
(2) Sodium salt of 2-caprylic-1-(ethyl β oxypropionic acid)-imidazoline Table II illustrates the ineffectiveness of Triton X200 (Ex. 6) Triton X165 (Ex. 7) and Monateric Cy—Na (Ex. 10) as anti-fog compounds. A comparison of Ex. 11 and 12 illustrates that the anti-fog properties of the compounds of the invention are dependent on concentration. Example 12 also illustrates that the compounds of the invention increase the relative speed of the emulsion after aging without causing any development of fog. Zero relative speed and gradation coefficient in Ex. 13 only indicate that the film, although having photographic sensitivity was stabilized to such a degree that the sensitivity and gradation coefficient couldn't be measured under the light exposure conditions employed.

EXAMPLES 14–21

A photographic film having an anti-abrasion layer was prepared and exposed in accord with the identical procedure outlined in Examples 1–4 except different surfactants were evaluated as anti-fog compounds and the relative speed, gradation coefficient and fog were measured immediately after coating and drying (fresh coatings), 3 days aging at 24°C. and 3 days oven aging at 46°C.

The results are given in Table III.

TABLE III

| Ex. | Surfactant | mg of surfactant per 2278 gram Coating solution | mg of surfactant overcoated per 100 mg of silver | FRESH Rel. Sp. | FRESH Grad. Coeff. | FRESH Fog | 3-Days Aging-24°C Rel. Sp. | 3-Days Aging-24°C Grad. Coeff. | 3-Days Aging-24°C Fog | 3 - Days Oven Aging-46°C Rel. Sp. | 3 - Days Oven Aging-46°C Grad. Coeff. | 3 - Days Oven Aging-46°C Fog. |
|---|---|---|---|---|---|---|---|---|---|---|---|---|
| 14 | Quadrol (1) | 285 | 0.0453 | | HEAVY FOG | | | HEAVY FOG | | | | |
| 15 | Tetronic 304 (2) | 285 | 0.0453 | | HEAVY FOG | | | HEAVY FOG | | | | |
| 16 | Tetronic 504 | 31 | 0.0050 | | HEAVY FOG | | | HEAVY FOG | | | | |
| 17 | Tetronic 504 | 310 | 0.0493 | 23 | 7 | 0.04 | 23 | 7 | 0.03 | 25 | 5 | 0.03 |
| 18 | Tetronic 504 | 3100 | 0.4637 | 0 | — | 0.00 | 0 | — | −0.00 | 0 | — | — |
| 19 | Tetronic 704 | 26 | 0.0042 | | HEAVY FOG | | | HEAVY FOG | | | | |
| 20 | Tetronic 704 | 260 | 0.0413 | 21 | 6 | 0.00 | 26 | 7 | 0.04 | | FOG | |
| 21 | Tetronic 704 | 2600 | 0.3889 | 0 | — | 0.00 | 0 | — | 0.00 | 0 | — | 0.00 |

(1) Registered Trademark BASF Wyandotte for [N,N,N',N',-tetrakis (2-hydroxypropyl) ethylene diamine]
(2) an addition product of propylene oxide and ethylene oxide to one mole of ethylene diamine and having a molecular weight of about 1650 and about 40 to about 49% by weight of oxyethylene groups based on the total amount of oxyethylene and oxypropylene groups It can be seen by reference to Table III that neither Quadrol (Ex. 14) nor Tetronic 304 (Ex. 15) acted as an anti-fog compound at the concentration tried. Example 17 illustrates that the compounds of the invention reduce the fog, increase the relative speed and improve the gradation coefficient upon aging. Examples 16 to 18 and 19 to 21 illustrate that the anti-fog properties obtained according to the invention are dependent on concentration of the compound. Zero relative speed in examples 18 and 21 as in Example 13 indicates that the film was stabilized to such a degree that the relative speed couldn't be measured under the light exposure conditions used but the film was light sensitive.

EXAMPLES 22–25

A photographic film was prepared and exposed substantially in accord with the procedure described in Examples 1–4 except a known anti-fog compound; (5-methyl-7-hydroxy-1,2,3-triazindolizine) was employed only in Example 22 and Tetronic 702 was employed as the only anti-fog compound in Examples 23 to 25. These anti-fog compounds were added to the emulsion at the end of the digestion and not the anti-abrasion layer as was done in the previous examples.

The relative speed, gradation coefficient and fog was measured immediately after coating and drying (fresh coating), aging for 5 days at 24°C. and 1 day aging at 46°C.

The results are given in Table IV.

TABLE IV

| Ex. | Stabilizer | mg of stabilizer per mole of silver | mg of stabilizer per 100 mg of silver | FRESH Rel. Sp. | FRESH Grad. Coeff. | FRESH Fog | Aging 5-Day - 24°C. Rel. Sp. | Aging 5-Day - 24°C. Grad. Coeff. | Aging 5-Day - 24°C. Fog | 1-Day Oven Aging-46°C Rel. Sp. | 1-Day Oven Aging-46°C Grad. Coeff. | 1-Day Oven Aging-46°C FOG |
|---|---|---|---|---|---|---|---|---|---|---|---|---|
| 22 | 5-methyl-7-hydroxy-1,2,3,-triazaindolizine | 750 | 0.6953 | 23 | 9 | 0.07 | 23 | 9 | 0.17 | HEAVY FOG | | |
| 23 | Tetronic 702 | 5 | 0.0046 | 16 | 6 | 0.03 | 15 | 6 | 0.07 | HEAVY FOG | | |
| 24 | Tetronic 702 | 50 | 0.0463 | 9 | 7 | 0 | 10 | 5 | 0 | 18 | 5 | 0 |
| 25 | Tetronic 702 | 500 | 0.4635 | 0 | — | 0 | 0 | — | 0 | 0 | — | |

A comparison of a standard anti-fog compound (Ex. 22) to one of the compounds of the invention (Ex. 24) clearly illustrates that by using lesser amounts of the compounds of the invention better anti-fog properties are obtained over the prior art compound and further the relative speed and gradation coefficient are improved (Ex. 24) on aging. A comparison of Ex. 23 to 25 illustrates that anti-fog properties of the compounds of the invention are dependent on concentration; the zero relative speed values for example 25 having the same significance as discussed with regard to Examples 13, 18 and 21.

Various ranges have been employed to describe the parameters of the invention and it is intended that where a range is employed it is to include a narrower range falling within the range as well as any value within the range. Thus, as examples and without limitation where the sum of $x$ and $x'$ and $n^2$, $n^3$, $n^4$ and $n^5$ have been given as a value that indicates the total number of lower oxyalkylene radicals is greater than about 33 to about 500 in the compounds of the invention it is intended that such a range also includes a narrower range such as for example 40 to about 350; about 70 to about 100 or about 50 to about 70 as well as any value within the broad range such as for example 34, 42, 50 as well as any individual values for each of $x$, $x'$, $n^2$, $n^3$, $n^4$ and $n^5$ for example 3, 5, 10, 20, 25, 30, 35 and the like. Similarly the definition of the radicals $R^1$ is intended to include for example 1 to about 6 carbon atom radicals, 2 to about 6 carbon atom radicals, and 4 and 5 carbon atom radicals whether they are cyclic or aliphatic. Similarly the values for the oxyethylene content previously discussed may be from about 20 to about 50% of the total oxyalkylene content which is intended to include about 20 to about 30%, about 30 to about 50%, about 30 to about 40% and any individual values within these ranges such as 25%, 35%, 40%, 45% and the like.

Although the invention has been described by reference to some preferred embodiments it is not intended that the invention be limited thereby but that modifications thereof are intended to be included within the spirit and broad scope of the foregoing disclosure and the following claims.

What is claimed is:

1. A photosensitive a silver halide photographic emulsion containing a water soluble anti-fog compound of the following formula:

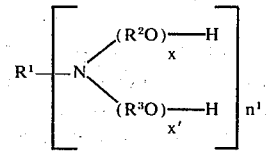

where $R^1$ is a lower alkylene radical having up to 6 carbon atoms,

—$R^2O$— and —$R^3O$— are the same or different lower oxyalkylene radicals, the sum of $x$ and $x'$ such that said compound has greater than about 33 to about 500 —$R^2O$— radicals and —$R^3O$— radicals, $n^1$ is a value greater than 1 and up to 2, said compound being present in said emulsion in an amount sufficient to reduce the fog of said emulsion.

2. The photosensitive emulsion of claim 1 where the sum of $x$ and $x'$ is such that said compound has from about 60 to about 180 —$R^2O$— and —$R^3O$— radicals.

3. The photosensitive emulsion of matter of claim 1 wherein said anit-fog compound has the formula:

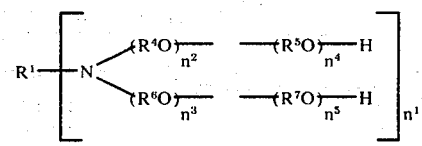

where $R^1$ is lower alkylene of up to 6 carbon atoms,

—$R^4O$— and —$R^6O$— are the same lower oxyalkylene radical,

—$R^5O$— and —$R^7O$— are the same lower oxyalkylene radicals and —$R^4O$— and —$R^6O$— are different from —$R^5O$— and —$R^7O$—, the sum of $n^2$, $n^3$, $n^4$, and $n^5$ is such that said compound has greater than about 33 to about 500 —$R^4O$—, —$R^5O$—, —$R^6O$—, and —$R^7O$— radicals, $n^1$ is a value greater than 1 and up to 2.

4. The photosensitive emulsion of claim 3 where the sum of $n^2$, $n^3$, $n^4$ and $n^5$ is such that said compound has from about 60 to about 180 —$R^4O$—, —$R^5O$—, —$R^6O$— and —$R^7O$— radicals.

5. The photosensitive emulsion of claim 4 where said anti-fog compound has the formula:

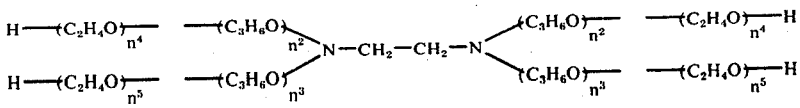

where $n^2$, $n^3$, $n^4$ and $n^5$ are defined in claim 4.

6. The photosensitive emulsion of claim 5 where said anti-fog compound has a molecular weight of from about 3400 to about 5500, and an oxyethylene content of from about 20 to about 50% of the total oxyethylene and oxypropylene radicals.

7. A photosensitive article of manufacture comprising a substrate having thereon a silver halide photographic emulsion layer containing a water soluble anti-fog compound of the following formula:

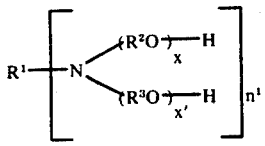

where $R^1$ is a lower alkylene radical having up to 6 carbon atoms, $—R^2O—$ and $—R^3O—$ are the same or different lower oxyalkylene radicals, the sum of $x$ and $x'$ is such that said compound has greater than about 33 to about 500 $—R^2O—$ and $—R^3O—$ radicals, $n^1$ is a value greater than 1 and up to 2, said compound being present in said emulsion in an amount sufficient to reduce the fog of said emulsion.

8. The photosensitive article of claim 7 where the sum of $x$ and $x'$ is such that said compound has from about 60 to about 180 $—R^2O—$ and $—R^3O—$ radicals.

9. The photosensitive article of claim 8 wherein said anti-fog compound has the formula:

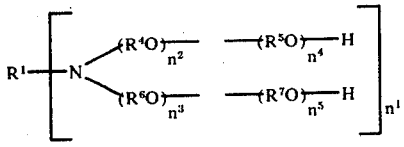

where $R^1$ is lower alkylene of up to 6 carbon atoms, $—R^4O—$ and $—R^6O—$ are the same lower oxyalkylene radicals, $—R^5O—$ and $—R^7O—$ are the same lower oxyalkylene radicals, and $—R^4O—$ and $—R^6O—$ are different from $—R^5O—$ and $—R^7O—$, the sum of $n^2$, $n^3$, $n^4$, and $n^5$ is such that said compound has greater than about 33 to about 180 $—R^4O—$, $—R^5O—$, $—R^6O—$, and $—R^7O—$ radicals, $n^1$ is 2.

10. The photosensitive article of claim 9 where the sum of $n^2$, $n^3$, $n^4$ and $n^5$ is such that said compound has from about 60 to about 180 $—R^4O—$, $—R^5O—$, $—R^6O—$, and $—R^7O—$ radicals.

11. The photosensitive article of claim 10 where said anti-fog compound has the formula:

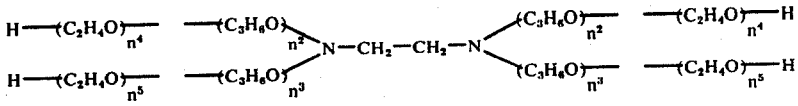

where $n^2$, $n^3$, $n^4$ and $n^5$ are defined in claim 10.

12. The photosensitive article of claim 11 where said anti-fog compound has a molecular weight of from about 3400 to about 5500, and an oxyethylene content of from about 20 to about 50% of the total oxyethylene and oxypropylene radicals.

13. The photosensitive article of claim 11 comprising an anti-abrasion layer on said silver halide photographic emulsion layer and said anti-fog compound is incorporated in said emulsion layer.

* * * * *